United States Patent [19]

Lagally et al.

[11] Patent Number: 4,720,840

[45] Date of Patent: Jan. 19, 1988

[54] COMPLIANT ANTIVIBRATION BAR FOR A STEAM GENERATOR

[75] Inventors: Hermann O. Lagally, Hempfield Township, Westmoreland County; Bernard L. Silverblatt, Mt. Lebanon; Thomas A. Pitterle, Greensburg; Norman R. Singleton, Penn Hills Township, Allegheny County, all of Pa.

[73] Assignee: Westinghouse Electric Corp., Pittsburgh, Pa.

[21] Appl. No.: 40,697

[22] Filed: Apr. 20, 1987

Related U.S. Application Data

[63] Continuation of Ser. No. 745,980, Jun. 18, 1985, abandoned.

[51] Int. Cl.[4] ..... G21C 9/00; F28F 7/00; F28F 9/00; F28D 7/00

[52] U.S. Cl. ..... 376/285; 165/69; 165/162; 29/400 N; 29/157.3 R; 29/723; 29/726

[58] Field of Search ..... 376/285; 165/69, 162; 29/400 N, 157.3 R, 723, 726

[56] References Cited

U.S. PATENT DOCUMENTS

| | | | |
|---|---|---|---|
| 1,928,009 | 9/1933 | Dornier . | |
| 2,927,781 | 3/1960 | Fohrhaltz et al. | 165/69 |
| 3,007,679 | 11/1961 | Byerley et al. | 257/239 |
| 3,163,208 | 12/1964 | Cuzzone et al. | 165/162 X |
| 3,199,582 | 8/1965 | Vogt et al. | 165/69 |
| 3,212,567 | 10/1965 | Ramonos | 165/69 |
| 3,292,691 | 12/1966 | Welter et al. | 165/162 |
| 3,360,039 | 12/1967 | Frei | 165/172 |
| 3,545,537 | 12/1970 | Hill, Jr. | 165/162 |
| 3,637,008 | 1/1972 | Michel et al. | 165/69 |
| 3,864,811 | 2/1975 | Walker . | |
| 4,204,570 | 5/1980 | Eisinger | 165/69 |
| 4,208,988 | 6/1980 | Jacobs et al. . | |
| 4,577,386 | 3/1986 | Faudou et al. . | |

FOREIGN PATENT DOCUMENTS

| | | | |
|---|---|---|---|
| 2200462 | 4/1974 | France . | |
| 685848 | 1/1953 | United Kingdom . | |
| 764866 | 1/1957 | United Kingdom | 165/162 |
| 813152 | 5/1959 | United Kingdom . | |
| 956129 | 4/1964 | United Kingdom . | |
| 1017455 | 1/1966 | United Kingdom | 165/162 |
| 1050025 | 12/1966 | United Kingdom . | |
| 1090535 | 11/1967 | United Kingdom . | |
| 1188564 | 4/1970 | United Kingdom . | |
| 1364571 | 8/1974 | United Kingdom . | |
| 1532100 | 11/1978 | United Kingdom . | |
| 1566633 | 5/1980 | United Kingdom . | |
| 2151766 | 7/1985 | United Kingdom . | |

OTHER PUBLICATIONS

European Search Report EP 85 30 8234.

*Primary Examiner*—Gene P. Crosby
*Assistant Examiner*—Carmine Cuda

[57] ABSTRACT

A steam generator for nuclear power plant applications. U-shaped heat exchanger tubes within said steam generator are provided with compliant antivibration bars at the U-shaped portion of the tubes. Flexible plates located at opposite sides of the antivibration bars are placed in contact with the opposite sides of the rows of tubes. Support ribs spaced along the length of the compliant bars limit the deflection of the flexible plates and establish the effective length of the flexible plates. The ribs in successive columns of antivibration bars are located between the ribs of the bars of each preceding and following row.

5 Claims, 5 Drawing Figures

COMPLIANT ANTIVIBRATION BAR FOR A STEAM GENERATOR

This is a continuation of application Ser. No. 745,980, filed June 18, 1985 and now abandoned.

CROSS-REFERENCE TO RELATED APPLICATIONS

This invention is related to patent applications entitled "Expandable Antivibration Bar for a Steam Generator" by H. O. Lagally, and "Antivibration Bar Installation Apparatus" by H. O. Lagally and J. H. Stevens, both of which are assigned to the Westinghouse Electric Corporation and both of which are being simultaneously filled herewith.

BACKGROUND OF THE INVENTION

1. Field of the Invention

This invention relates in general to the field of steam generators for commercial nuclear power plants and in particular to apparatus for preventing vibration of the tubes of steam generators and more particularly to apparatus for eliminating clearance space between the tubes of a steam generator and the antivibration bars disposed between the rows of the tubes and thereby eliminating the vibration of said tubes during operation of the steam generator.

2. Description of the Prior Art

Nuclear power plants have been safely producing electricity for many years. The principal of operation of such commercial nuclear power plants is well known. A nuclear core containing fissionable fuel is caused to achieve criticality and thereby produces heat. The heat is removed by a reactor coolant, which in the field of pressurized water reactors, comprises water. The water reactor coolant also serves as a nuclear moderator which thermalizes fast neutrons in order to enhance the probability of the neutrons producing additional nuclear fissions and thereby sustaining the nuclear reaction.

The heat produced by the nuclear core is transferred to the reactor coolant as it passes through the nuclear reactor core. The reactor coolant subsequently transfers the heat it has received to another medium, which also comprises water and which is transformed into steam. The steam is then used to generate electricity by conventional steam turbine-electrical generator apparatus.

The reactor coolant transfers its heat to the secondary medium in steam generators specifically designed for the nuclear power field. The design of such nuclear steam generator is well known in the art. In general, the steam generator design comprises a plurality of small diameter tubes which are housed within a pressure-bearing container in such a manner as to allow and promote the transfer of heat to produce steam.

In particular, the design of some nuclear steam generators includes an outer shell comprising an elongated, circular cylinder having rounded ends attached thereto. A large number of U-shaped tubes oriented along the longitudinal axis of the cylinder, are disposed in the lower cylindrically-shaped portion of the steam generator. The lower portion has a lower or bottom end thereof associated with a channel head typically of a hemispherical configuration. The channel head is divided by a partition into a first half typically known as the hot leg, and a second half typically known as the cold leg. The high temperature reactor coolant from the nuclear reactor is input into the steam generator through a primary coolant inlet nozzle into the hot leg. The reactor coolant then flows from the hot leg into the exposed openings of the plurality of U-shaped tubes, through the tubes and then through the cold leg portion of the channel head. Finally, the reactor coolant exits from the steam generator through a primary coolant outlet nozzle.

The portion of the steam generator primarily including the bundle of U-shaped tubes and the channel head is typically referred to as the evaporator section. The steam generator further includes a steam drum section which is located at the upper end of the cylindrical shell of the steam generator. Moisture separators are located within the steam drum section. Feedwater enters the steam generator through an inlet nozzle which is disposed in the upper portion of the cylindrical shell. The feedwater is distributed and mixed with water removed by the moisture separation and then flows down an annular channel surrounding the tube bundle. The feedwater then reverses direction and passes up around the outside of the tubes of the tube bundle where it absorbs heat from the reactor coolant flowing within the tubes. The heat absorbed causes the feedwater to boil and produce steam. The steam produced by the boiling water rises into the steam drum section. The moisture separator then removes the water entrained within the steam before it exits from the steam generator through a steam outlet. The steam then flows to the steam turbine which is connected to an electrical generator. Subsequently, the steam from the steam turbine is condensed and rerouted into the steam generator to continue the flow cycle.

The U-shaped tubes are supported at their open ends by conventional means whereby the ends of the tubes are seal welded to a tube sheet which is disposed transverse to the longitudinal axis of the steam generator. A series of tube supports arranged in spaced relationship to each other are provided along the straight portion of the tubes in order to support such portion of the tubes. An upper tube support assembly is utilized to support the U-shaped portion of the tubes of the tube bundle. The upper assembly comprises a plurality of retainer rings arranged around the outside of the tube bundle in spaced relationship to each other.

The retaining rings, like the tube supports, are arranged substantially transverse to the longitudinal axis of the steam generator. Each retaining ring is generally of an oval shape which coincides with the outer periphery of the tube bundle at the particular location of the retaining ring. Thus, the size of the oval of the retaining rings decreases with the distance toward the upper end of the tube bundle. The uppermost retaining ring, therefore, is relatively small inasmuch as it is located at the uppermost portion of the tube bundle where the shape of the tube bundle is rapidly converging.

Each of the retaining rings is connected to a plurality of antivibration bars which are typically disposed between each column of the U-shaped portion of the tubes. In some steam generators, the antivibration bars comprise a bar bent into a V-shaped configuration such that two legs are formed with an angle therebetween. The V-shaped bars are inserted between successive columns of the steam generator flow tubes. The V ends of the bars are inserted between the flow tubes; the free ends of the bars are welded to opposite sides of the appropriate retainer ring. In this manner, each of the tubes of the tube bundle is supported along the length of the curved or U-shaped portion at a number of spaced locations by an antivibration bar. This arrangement provides line support and yet allows the feedwater to flow around and between the curved portion of the steam generator tubes. In other words, the antivibration bars provide support and do not substantially interfere with the flow of the feedwater.

The antivibration bars are intended to prevent excessive vibrations of the individual tubes of the entire tube bundle. It is well known that the vibrations in question are caused by flow of the water and steam past the flow tubes. These flow-induced vibrations can potentially damage the flow tubes. It is also well known that the U-shaped portion of the tube bundle is severely affected by the vibrations, and, because of the bent configuration, the most difficult to adequately support in order to eliminate the flow-induced vibrations. Further, it is well accepted that current hydraulic and dynamic response technology cannot exactly define nor completely eliminate the root cause of the vibrations. It has been, therefore, left to mechanical means to attempt to completely or at least substantially eliminate the vibration problem. While the advent of the antivibration bars or similar technology has materially reduced the magnitude and presence of vibration, they have not completely eliminated damaging vibrations.

The mechanical aspects of the curved or bent portion of the tubes of the tube bundle are the major obstacles in the way of a mechanical solution to the problem.

The U-shaped tubes of the tube bundle have dimensional tolerances associated with their outer diameter. There are also variations caused by ovalization of the tubes as a result of the bending. Furthermore, the spatial relationship between adjacent tubes is a variable, albeit within set design limits. Thus, there is a dimensional tolerance associated with the nominal spacing between the steam generator tubes. There is also a dimensional tolerance associated with the outer dimensions of the prior art vibration bars, which as explained above, typically comprise rectangular bars. They may also comprise a square, an oval, or any other shape having a uniform or a nonuniform cross-sectional shape. However, notwithstanding the particular shape chosen, there is the dimensional tolerance associated with the size of the bars. The combination of these tolerances and dimensional variances prevents the elimination of gaps between the antivibration bars and the tubes of the steam generator. Any gaps are, of course, undesirable because they allow vibration of the tubes and relative motion between the tubes and the antivibration bars. The relative motion can cause wear and subsequent failure to the tubes of the steam generator. There have been numerous attempts in the prior art to minimize gaps. Unfortunately, decreasing the size of the gaps only decreases the magnitude of the problem, it does not eliminate the problem.

In U.S. patent application Ser. No. 670,728, filed Nov. 13, 1984 by B. C. Gowda et al., and assigned to the Westinghouse Electric Corporation, a novel approach is disclosed to eliminate gaps between the steam generator tubes and the antivibration bars. That application provided a method whereby hollow antivibration bars are expanded in place between the rows of steam generator tubes to eliminate the gaps due to dimensional variations. While such method is obviously a step in the right direction, it does have its limitations. Such method is difficult to use with previously operated steam generators which may be or are radioactive and where it is required to perform the installation under water with remotely-operated tools and where the spacing between adjacent tubes is further variable due to a buildup of deposits due to steam generator operation. With this method of expansion, it is also difficult to control the expansion in order to obtain final controlled clearances. There is, then, the need for other means and apparatus to prevent vibration of the steam generator tubes and the relative motion between the antivibration bars and the steam generator tubes.

Accordingly, an object of the present invention is to provide apparatus to prevent operational vibrations of the tubes of a steam generator.

Another object of the present invention is to provide antivibration bar apparatus which virtually eliminates any gap between the antivibration bar and the tubes of a steam generator.

Another object of the present invention is to provide antivibration bar apparatus which is capable of being easily installed in a steam generator which has been previously operated and may include mineral deposits on the tubes of the steam generator.

Another object of the present invention is to provide antivibration bar apparatus which is capable of being readily installed in a steam generator which has been previously operated and may be radioactive.

SUMMARY OF THE INVENTION

The above specifically-expressed objects as well as those implied but not expressed and based upon a fair reading and interpretation of this specification are provided by the present invention which comprises a compliant or flexible support between successive rows of steam generator tubes in the portion where the tubes are bent into a U-shaped configuration.

Compliant antivibration bars are bars which are slotted in the plane of columns of tubes to present a compliant support for the tubes of the steam generator in contact with the bars. The slotted bars are inserted between columns of tubes and attached at their ends to retainer rings surrounding the exterior periphery of the bundle of tubes. Ribbed sections, provided between slotted sections along the length of the bar, provide support to and connections between the compliant sections of the bars. In positioning the bars to the tube bundle, the ribs of one bar are positioned to line up with a highly compliant portion of the bars in the adjacent tube column gaps either side of the bar in question.

Various other objects, advantages and features of the invention will become apparent to those skilled in the art from the following description taken in conjunction with the following drawings, in which:

DESCRIPTION OF THE PREFERRED EMBODIMENTS

Figure 1:
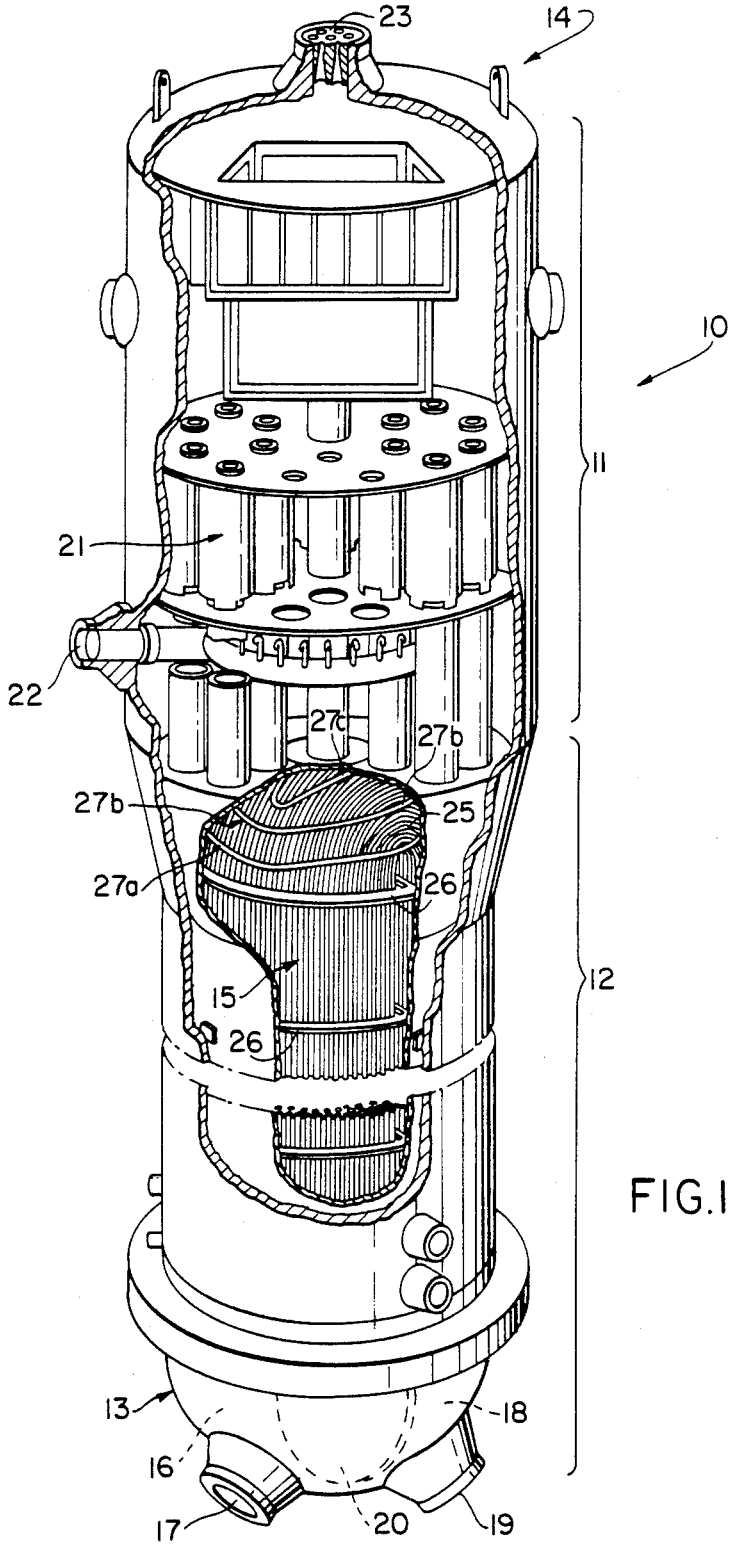
FIG. 1 is a perspective view partially in cross section of a nuclear steam generator having U-shaped bent tubes to which the antivibration apparatus of the present invention is applied.
Figure 2:
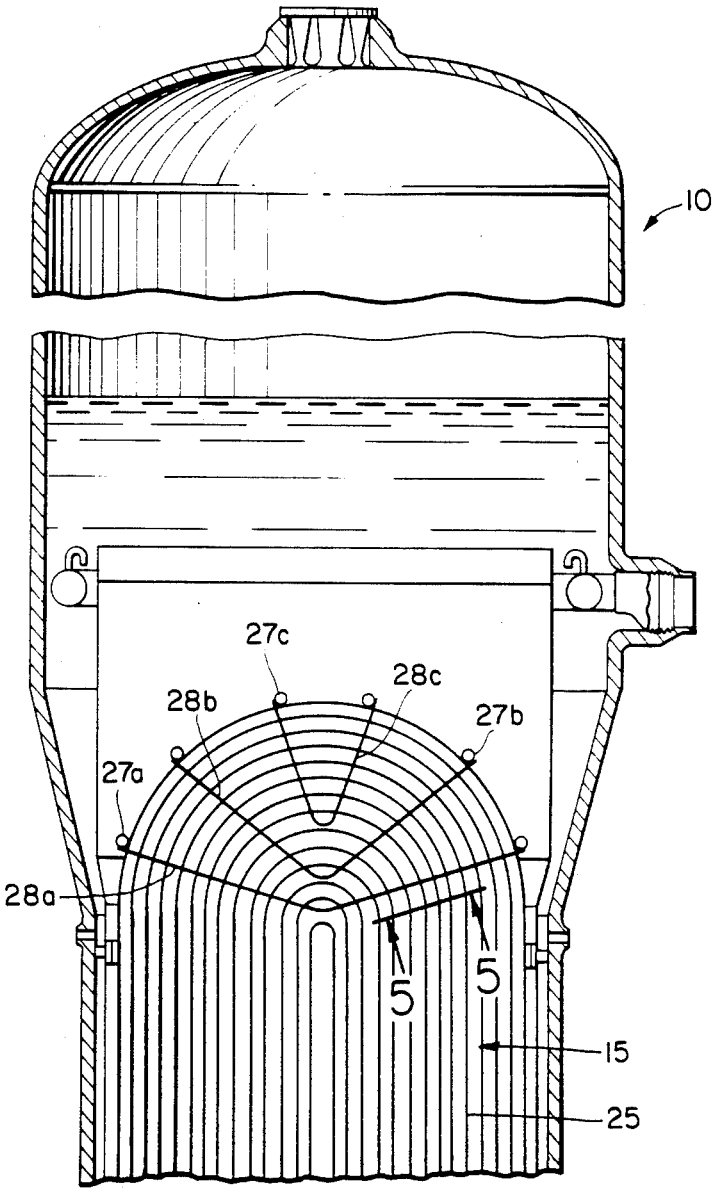
FIG. 2 is a schematic rendering of an axial section of the upper portion of the steam generator of FIG. 1, particularly illustrating the bent portion of the flow tubes and a typical installation position of the antivibration apparatus of the present invention.

Referring now to the drawings where like characteristics are referred to by the same reference numerals among the various figures and in particular to FIGS. 1 and 2 which depict a typical steam generator to which the present invention may be applied. To the extent that the steam generator is described and explained in the description of prior art above, that description and explanation of operation is incorporated in the embodiment shown and described herein by reference as if fully set forth.

The nuclear steam generator 10 comprises a substantially cylindrical shell having upper 11 and lower 12 portions. A hemispherical head or channel head 13 is sealingly attached to the lower portion 12; another head 14 is sealingly attached to the upper portion 11. A bundle 15 of U-shaped tubes is disposed within the lower portion 12. One open end of the tube bundle 15 is in flow communication with the hot leg 16 of channel head 13 and a primary coolant flow inlet nozzle 17. The other open end of the tube bundle 15 is in flow communication with the cold leg 18 of channel head 13 and a primary coolant flow outlet nozzle 19. A partition 20 divides the hot 16 and cold 18 legs of the channel head 13. Thus, hot reactor coolant flows into steam generator 10 through inlet nozzle 17, through hot leg 16 into tube bundle 15, through and out of tube bundle 15. The now cooled reactor coolant flows through cold leg 18 and out of outlet nozzle 19 and back to the nuclear reactor to continue the flow cycle.

That portion 12 of the steam generator 10 primarily including the tube bundle 15 and channel head 13 is referred to as the evaporator portion. The upper portion 11 of steam generator 10 is normally referred to as the steam drum portion which includes a moisture separator 21. Feedwater enters the steam generator 10 through an inlet nozzle 22 and mixes with water removed by the moisture separator 21. The feedwater flows down an annular channel surrounding tube bundle 15 and is introduced into tube bundle 15 at the bottom thereof. The mixture of feedwater and recirculating water then flows up through tube bundle 15 where it is heated to a boil by the water flowing within the tubes 25 of tube bundle 15. The steam produced by the boiling feedwater rises up into the steam drum portion 11 where the moisture separator 21 removes water entrained within the steam before the steam exits through a steam outlet nozzle 23. The steam then flows to a steam turbine (not shown) and subsequently back into the steam generator where the cycle is continued.

The U-shaped tubes 25 are supported along their straight lengths in the configuration of the tube bundle 15 by a series of support plates 26. The bent or U-shaped portion of tubes 25 are supported by an assembly comprising a series of retainer rings **27*a*, 27*b*, and 27*c*. Each of the retainer rings is generally of round or oval configuration with 27*b* being smaller than 27*a*, and 27*c* progressively smaller than 27*b*. A plurality of sets of antivibration bars 28 is disposed between adjacent columns of the U-shaped tubes 25. One such set of antivibration bars 28 is more clearly shown in FIG. 2, it being understood that successive sets of similar antivibration bars 28 are disposed behind and in front of the illustrated set. Each of the antivibration bars 28*a*, 28*b*, and 28*c* is of a V-shaped configuration with differing included angles and with the ends thereof attached, such as by welding, to symmetrically opposite points of the respective retainer rings 27*a*, 27*b*, and 27*c*. FIG. 2 illustrates a cross-sectional schematic view taken through the tube bundle 15 showing that the antivibration bars 28*a*, 28*b*, and 28*c* are disposed to support the bent or U-shaped portion of tubes 25, noting the row and column arrangement of tubes 25**.

Figure 3:
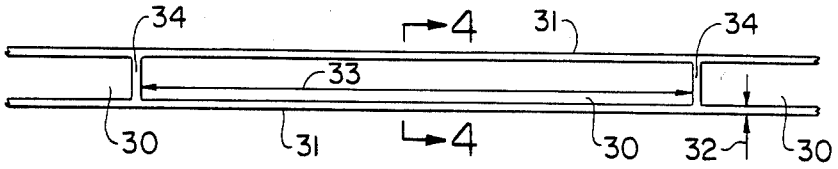
FIG. 3 schematically illustrates one embodiment of the antivibration bars of the present invention.
Figure 4:
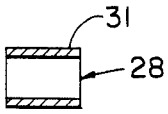
FIG. 4 is a cross-sectional view of the bar of FIG. 3, taken along the line 4—4; and, FIG. 5 is a schematic drawing of one method of installing the antivibration bars of the present invention between columns of steam generator tubes, taken along the line 5—5 of FIG. 2.
Figure 5:
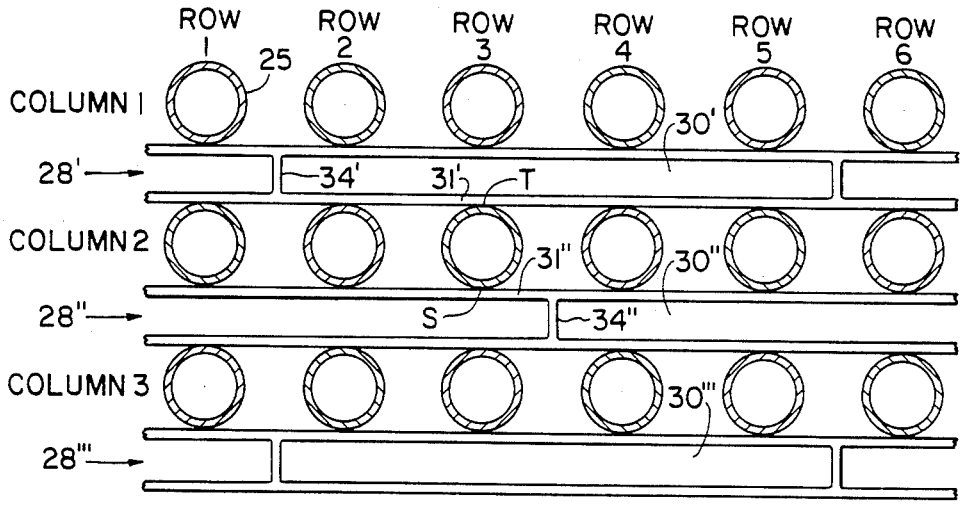

A portion of a compliant antivibration bar 28 as disclosed by the present invention is shown in FIG. 3. A cross-sectional view of bar 28 is shown in FIG. 4. Antivibration bar 28 may have an overall square or rectangular cross-sectional configuration. An elongated slot 30 is provided through bar 28 with the longitudinal axis of bar 28. In this manner, compliant support plates 31 are formed on each support side of antivibration bar 28. The thickness 32 of plates 31 and length 33 of slot 30 may each be varied in order to achieve a desired degree of flexibility of plates 31. Moreover, the thickness 31 may be varied (not shown) along the length 33 of slot 30 in order to achieve an overall spring rate or compliance factor of the antivibration bars 28 when disposed to support the steam generator tubes 25 as shown in FIG. 5 and more fully explained below.

Ribs 34 are provided at the ends of the slots 30 transverse to support plates 31 and transverse to the longitudinal axis of antivibration bars 28. Ribs 34 prevent deflection of plates 31 at the location of the ribs 34. Ribs 34 also provide a convenient means to limit the length of slots.

Construction of antivibration bars 28 may be from a single solid elongated bar with slots 30 machined therethrough and with ribs 34 comprising unmachined portions of the solid bar. Or, support plates 31 and ribs 34 may be individually welded together to form the shape shown in FIGS. 3 and 4. Or, two support plates 31 and a cylindrical rib may be welded together.

The spring rate of the slotted region of antivibration bars 28 between successive ribs 34 is designed to be much lower than the cross-sectional spring rate of the tubes 25 of the steam generator by appropriate adjustment of the thickness 32 of plates 31 and the length 33 of slots 30. The length 33 of slots 30 is also limited by the need to minimize the elastic deflection of the antivibration bar 28 at tube locations in the same column but adjacent to the load applied by a tube 25 interposed between the adjacent tubes. The actual spring rate of the antivibration bars 28 in relation to the spring rate of tube 25 is, however, a factor of the series combined spring rates of the antivibration bars 28 in successive columns on either side of the tube 25 in question.

FIG. 5 schematically illustrates one arrangement of the positioning of antivibration bars 28 between successive columns of tubes 25. Column 1, column 2, and column 3 comprise successive columns of steam generator tubes 25. Rows 1 through 6 comprise adjacent rows of tubes 25 in the respective columns of tubes 25. Other than to illustrate successiveness, the row and column numbers are meaningless. Antivibration bars 28′, 28″, and 28‴ are arranged such that the ribs 34 of the successive rows of bars 28 are staggered. Thus, ribs 34″ is in alignment with the longitudinal center of slots 30′ and 30‴. Such arrangement offsets the rigid effect of ribs 34 on the spring rate of the antivibration bars experienced by tubes 25. For example, tube 25 in column 2 and row 3 will be subjected to an effective spring rate R comprised of the spring rate R″ of the short length of plate 31″ between the contact point S of tube 25 and rib 34″ and spring rate R′ of the long length of plate 31′ between contact point T and rib 34′. The combined spring rate R will be less than either of the individual spring rates R′ and R″ since the effective series spring rate is always less than the lowest individual spring rate within the series. In this manner, the tubes 25 will not experience significant or damaging loading because the lowest spring rate (of plate 31′) is much less than the spring rate of the tube 25 section.

The arrangment shown in FIG. 5 is not meant to limit the invention. A number of other arrangements in conjunction with different lengths 33 of slots 30 are possible and intended to be included within the scope of the present invention. In particular, the invention may be used in combination with expandable types of antivibration bars as disclosed in the referenced copending patent application filed herewith, in which expansion of these bars forces the flow tubes in contact with the sides 31 of the present invention. It will be further appreciated that in addition to attaining the primary object of virtually eliminating any gap between antivibration bars and the steam generator tubes, the present invention substantially negates the loading effect on the tubes due to a buildup of deposits as a result of steam generator operation.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

We claim as our invention:

1. A steam generator for a nuclear power plant comprising a shell, a plurality of flow tubes having an approximate U-shaped configuration within said shell and arranged in successive columns and rows so as to form an array having a square pattern with spaces therebetween, and compliant antivibration bars fitting between each successive column of tubes and comprising a pair of parallel arranged flexible strips having a space therebetween and supported along the length thereof by spaced ribs, the spacing of said ribs being at least as long as the spacing of four tubes in a single column of tubes, with each successive and parallel antivibration bar being positioned such that its ribs are staggered relative to the position of the ribs of the preceding and parallel antivibration bar.

2. The apparatus of claim 1, including at least one retaining ring arranged around the periphery of said plurality of flow tubes of said steam generator with a plurality of said antivibration bars being attached at their ends to said at least one retaining ring.

3. The apparatus of claim 2, wherein each antivibration bar is bent along its length at the center thereof thereby forming a vee shape and said antivibration bars being attached to said at least one retaining ring are fitted to the steam generator tubes at the location of said approximate U-shaped configuration.

4. The apparatus of claim 3, wherein said at least one retaining ring comprises three retaining rings spaced from each other so as to provide antivibration support to the entire U-shaped portion of said steam generator flow tubes.

5. The apparatus of claim 4, wherein the combined effective spring rate of the antivibration bars on both sides of a column of steam generator tubes at any location of one of said tubes is less than the effective spring rate of said one of said tubes.

* * * * *